US007374183B1

(12) United States Patent
Yen-Lung

(10) Patent No.: US 7,374,183 B1
(45) Date of Patent: May 20, 2008

(54) LUGGAGE CASE WITH HIDDEN RETRACTABLE HANDLE UNIT

(76) Inventor: Tsai Yen-Lung, P.O. Box 55-124, Taichung (TW)

( * ) Notice: Subject to any disclaimer, the term of this patent is extended or adjusted under 35 U.S.C. 154(b) by 0 days.

(21) Appl. No.: 11/707,033

(22) Filed: Feb. 16, 2007

(51) Int. Cl.
*B62B 1/00* (2006.01)
*B62B 7/06* (2006.01)
*B62B 7/02* (2006.01)

(52) U.S. Cl. ..... 280/37; 280/47.26; 280/47.24

(58) Field of Classification Search ..... 280/37, 280/47.26, 47.24
See application file for complete search history.

(56) References Cited

U.S. PATENT DOCUMENTS 5,431,428 A * 7/1995 Marchwiak et al. ..... 280/655
5,575,362 A * 11/1996 Franklin et al. ..... 190/115
5,653,319 A * 8/1997 Wang ..... 190/115
6,098,768 A * 8/2000 Tsai ..... 190/18 A
6,186,295 B1 * 2/2001 Lin et al. ..... 190/18 A
6,360,400 B1 * 3/2002 Chang ..... 16/113.1
6,536,568 B1 * 3/2003 Tong ..... 190/101
7,082,641 B1 * 8/2006 Jung et al. ..... 16/114.1

* cited by examiner

*Primary Examiner*—Christopher P. Ellis
*Assistant Examiner*—John R. Olszewski

(57) ABSTRACT

A wheeled luggage case includes a main body having a rectangular housing so as to define an interior and the housing includes a back panel which has a back portion connected to the back panel by a zipper. A base frame is located in the main body and has two corner members. A wheel unit is connected to the base frame and has two wheels. A back plate is located in the main body and a lower edge of the back plate is connected between the corner members and the wheel unit. A handle unit is located between the back plate and the back portion of the housing, and includes two retractable tubes and a handle connected between the two retractable tubes. The handle extends through an opening defined in a top of the back panel.

5 Claims, 3 Drawing Sheets

LUGGAGE CASE WITH HIDDEN RETRACTABLE HANDLE UNIT

FIELD OF THE INVENTION

The present invention relates to a wheeled luggage case having a retractable handle unit which is composed of less number of parts.

BACKGROUND OF THE INVENTION

A conventional wheeled luggage case known to applicant is disclosed in U.S. Pat. No. 6,098,768 and generally includes a main body having a main frame sandwiched between an inner frame and an outer frame, two wheel assemblies connected to a bottom of the luggage case, a rear panel covering the rear of the main body to form a storage space, an L-shaped support plate connected to the bottom of the main frame and the wheel assemblies extending through two openings in the support plate, two U-shaped enhanced members connected to the wheel mount an the support plate, and a retractable handle connected to the support plate and being capable of storage in the storage space at the rear of the luggage case.

However, there are so many parts are involved for the wheeled luggage case and the assembling time is too long to obtain a competitive commercial product in the market.

The present invention intends to provide a wheeled luggage case having a hidden retractable handle unit which is composed of less number of parts when compared with that of the wheeled luggage case disclosed in U.S. Pat. No. 6,098,768.

SUMMARY OF THE INVENTION

The present invention relates to a wheeled luggage case which comprises a main body having a rectangular housing so as to define an interior and the housing includes two side panels, a top panel connected between the two side panels and a back panel connected to the two side panels and the top panel. The back panel has a back portion which is connected to the back panel by a zipper. An opening is defined in a top of the back panel. A back plate is located in the main body and connected to the side panels and the top panel. A base frame is located in the main body and has two posts and a transverse bar which is connected between two tops of the two posts. Two corner members are connected to two corners of an underside of the base frame. A wheel unit has an elongate frame and two wheel covers are connected on two ends of the elongate frame. Two wheels are connected to the elongate frame and partially covered by the two wheel covers. The wheel unit is connected to the base frame. The back plate is located between the corner members and the wheel unit. A handle unit has two parallel outer tubes and each outer tube has at least one inner tube retractably received therein. A handle is connected between the two inner tubes. The two outer tubes are connected to the base frame and the wheel unit. The handle extends through the opening of the back panel.

The primary object of the present invention is to provide a wheeled luggage case wherein the handle unit is hidden in the back of the luggage case and the handle unit is composed of less number of parts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
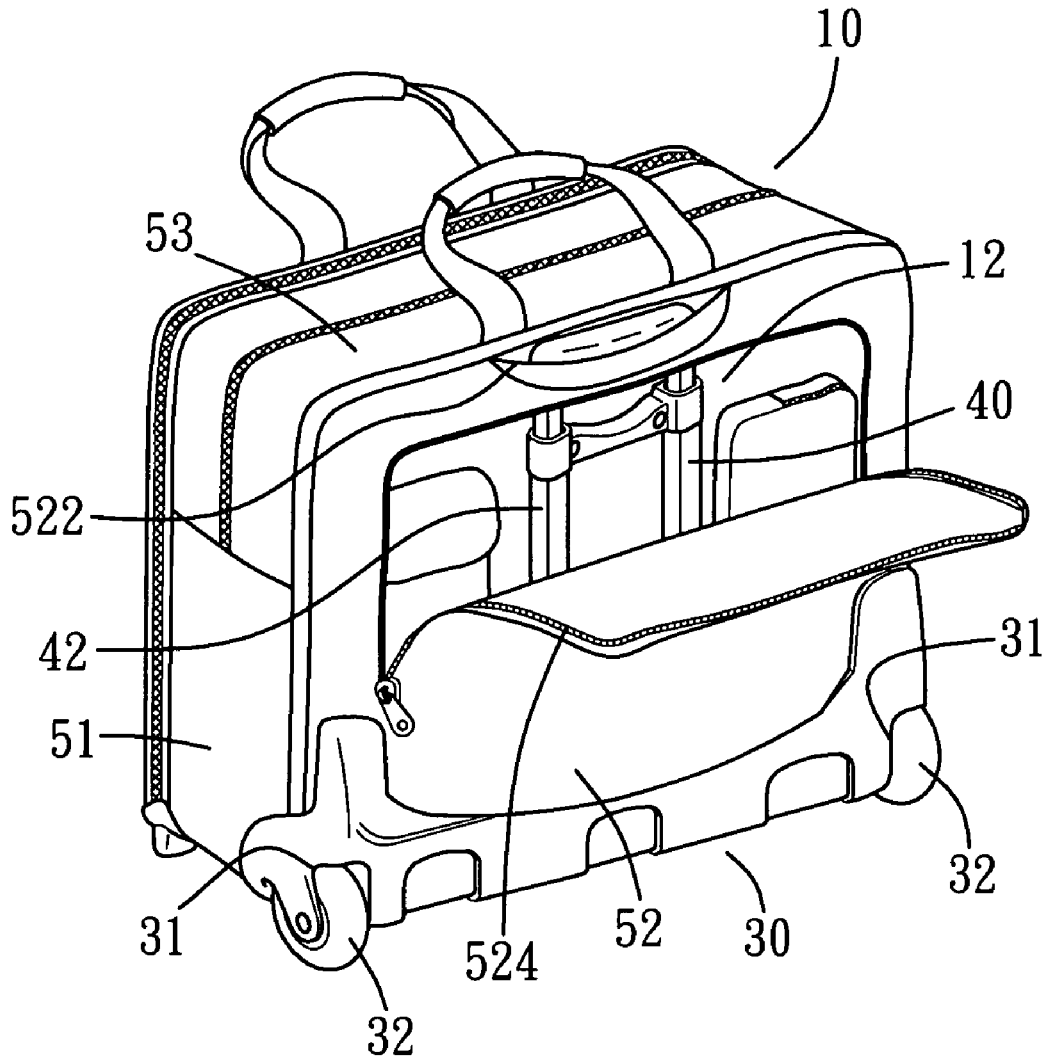
FIG. 1 is a perspective view to show the wheeled luggage case of the present invention.
Figure 2:
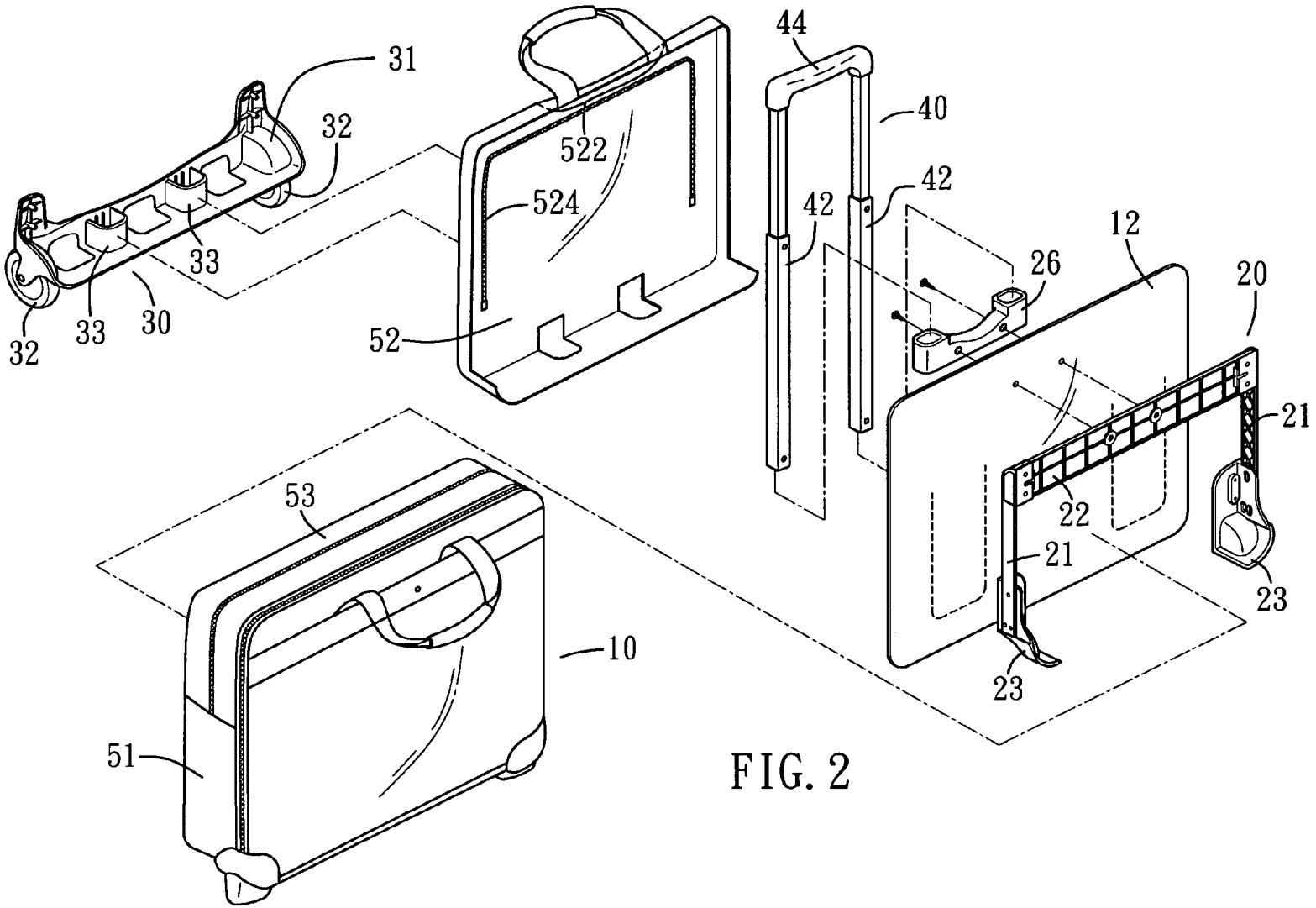
FIG. 2 is an exploded view to show the wheeled luggage case of the present invention.
Figure 3:
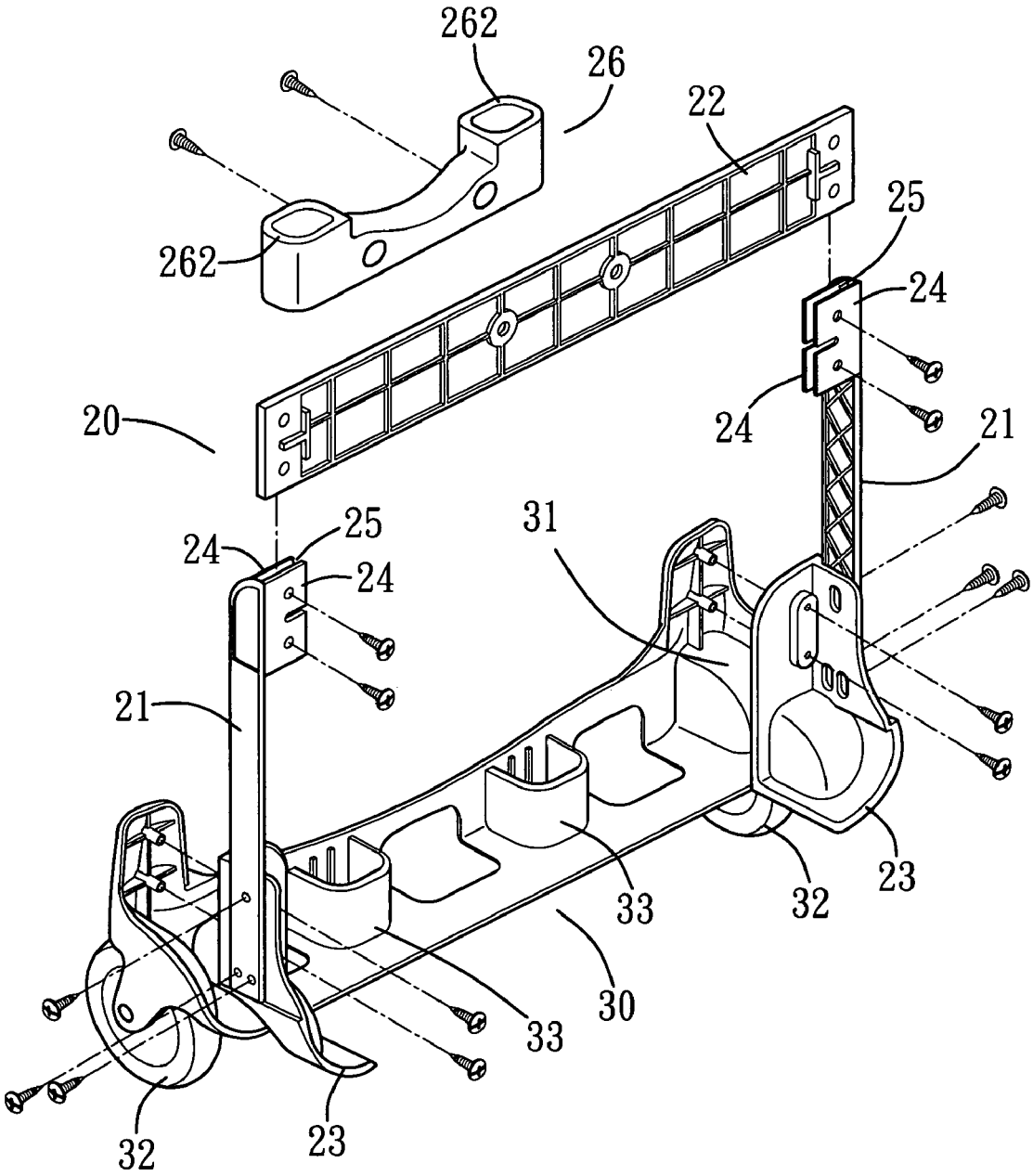
FIG. 3 is an exploded view to show the base frame and the wheel unit of the wheeled luggage case of the present invention.

Referring to FIGS. 1 to 3, the wheeled luggage case of the present invention comprises a main body 10 having a rectangular housing so as to define an interior and the housing includes two side panels 51, a top panel 53 and a bottom panel respectively connected between the two side panels 51 and a back panel and a front panel respectively connected to the two side panels 51, the bottom panel and the top panel 53. The back panel has a back portion 52 which is connected to the back panel by a zipper 524. An opening 522 is defined in a top of the back panel. A back plate 12 is located in the main body 10 and connected to the side panels 51 and the top panel 53.

A base frame 20 is located in the main body 10 and has two posts 21 and two connection members 24 are respectively connected to two top ends of the two posts 21 of the base frame 20. Each connection member 24 has a slot 25 and two ends of a transverse bar 22 are inserted into the two respective slots 25 of the two connection members 24. Bolts extend through the connection members 24 and the two ends of the transverse bars 22 so as to securely connect the transverse bar 22 to the two posts 21. Two corner members 23 are connected to two corners of an underside of the base frame 20;

A wheel unit 30 has an elongate frame and two wheel covers 31 are connected on two ends of the elongate frame, Two wheels 32 are connected to the elongate frame and partially covered by the two wheel covers 31. The wheel unit 30 is connected to the base frame 20 by connecting the two corner members 23 to the wheel unit 30 by bolts. The lower end of the back plate 12 is located between the corner members 23 and the wheel unit 30.

A handle unit 40 is located between the back plate 12 and the back portion 52 of the housing, and includes two parallel outer tubes 42 and each outer tube 42 has at least one inner tube retractably received therein. A handle 44 is connected between the two inner tubes. The two outer tubes 42 are connected to the base frame 20 and the wheel unit 30. The handle 44 extends through the opening 522 of the back panel.

The wheel unit 30 includes two cup members 33 connected to the elongate frame thereof and each cup member 33 has a recess defined therein. A bridge member 26 is connected to the transverse bar 22 and has two passages 262 through which the two outer tubes 42 of the handle unit 40 extend. Two distal ends of the two outer tubes 42 are securely received in the two cup members 33. The two outer tubes 42 are connected to the two cup members 33 by bolts.

The space between the back portion 52 and the back plate 12 can also be used as a storage space. The handle 44 can be pulled out via the opening 522 when using the wheeled luggage case in airport. The handle unit 40 is covered and protected by the back portion 52 when multiple luggage cases are transported or stacked.

While we have shown and described the embodiment in accordance with the present invention, it should be clear to those skilled in the art that further embodiments may be made without departing from the scope of the present invention.

What is claimed is:

1. A wheeled luggage case comprising:

a main body having a rectangular housing so as to define an interior, the housing including two side panels, a top panel connected between the two side panels and a back panel connected to the two side panels and the top panel, the back panel having a back portion which is connected to the back panel by a zipper, an opening defined in a top of the back panel, a back plate located in the main body and connected to the side panels and the top panel;

a base frame located in the main body and having two posts and a transverse bar which is connected between two tops of the two posts, two corner members connected to two corners of an underside of the base frame;

a wheel unit having an elongate frame and two wheel covers connected on two ends of the elongate frame, two wheels connected to the elongate frame and partially covered by the two wheel covers, the wheel unit connected to the base frame, the back plate located between the corner members and the wheel unit, and a handle unit having two parallel outer tubes and each outer tube having at least one inner tube retractably received therein, a handle connected between the two inner tubes, the two outer tubes connected to the base frame and the wheel unit, the handle extending through the opening of the back panel, the handle unit located between the back plate and the back portion of the housing.

2. The wheeled luggage case as claimed in claim 1, wherein two connection members are respectively connected to two top ends of the two posts of the base frame and each connection member has a slot, two ends of the transverse bar are inserted into the two respective slots of the two connection members, bolts extend through the connection members and the two ends of the transverse bars.

3. The wheeled luggage case as claimed in claim 1, wherein the two corner members are connected to the wheel unit by bolts.

4. The wheeled luggage case as claimed in claim 1, wherein the wheel unit includes two cup members connected to the elongate frame thereof and each cup member having a recess defined therein, a bridge member is connected to the transverse bar, the bridge member having two passages through which the two outer tubes of the handle unit extend, two distal ends of the two outer tubes are securely received in the two cup members.

5. The wheeled luggage case as claimed in claim 4, wherein the two outer tubes are connected to the two cup members by bolts.

* * * * *